US012453902B2

(12) United States Patent
Chen

(10) Patent No.: US 12,453,902 B2
(45) Date of Patent: Oct. 28, 2025

(54) RESISTANCE YOGA POST DEVICE FOR FITNESS

(71) Applicant: Qichang Chen, Liuyang (CN)

(72) Inventor: Qichang Chen, Liuyang (CN)

( * ) Notice: Subject to any disclaimer, the term of this patent is extended or adjusted under 35 U.S.C. 154(b) by 162 days.

(21) Appl. No.: 18/315,258

(22) Filed: May 10, 2023

(65) Prior Publication Data

US 2024/0342561 A1 Oct. 17, 2024

(51) Int. Cl.
*A63B 26/00* (2006.01)

(52) U.S. Cl.
CPC ..... *A63B 26/003* (2013.01)

(58) Field of Classification Search
CPC ..... A63B 26/003; A61H 2201/0153; A61H 2201/0157; A61H 2201/1253; A61H 2201/1284; A61H 2201/1695; A61H 2205/108; A61H 7/001
See application file for complete search history.

(56) References Cited

U.S. PATENT DOCUMENTS 3,106,395 A * 10/1963 Birkenbeul ..... A61H 15/00 601/121
3,633,905 A * 1/1972 Etchelecou ..... A63B 26/003 472/127
3,845,952 A * 11/1974 McKinney ..... A63B 26/003 482/112
3,887,179 A * 6/1975 Klepper ..... A63B 26/003 472/127
6,071,253 A * 6/2000 Rivera ..... A61H 15/00 601/118
6,811,539 B1 * 11/2004 Nguyen ..... A61H 23/02 601/28
10,765,910 B2 * 9/2020 Salamone ..... A63B 21/4037
2014/0171279 A1 * 6/2014 Justice Velasco ..... A63B 26/00 482/142

* cited by examiner

*Primary Examiner* — Andrew M Kobylarz
(74) *Attorney, Agent, or Firm* — Hemisphere Law, PLLC; Zhigang Ma

(57) ABSTRACT

A resistance yoga post device for fitness is provided. The device includes a drum. At least one side of the drum is provided with a first resistance sheet and a first screwing part, and the first screwing part is connected to an end of the roller in the drum through the first resistance sheet. A first support is arranged between the first screwing part and the first resistance sheet, the first resistance sheet is disposed in the first support, and the first screwing part is connected to the end of the roller in the drum through the first support. The resistance yoga post device for fitness is easy to install and disassemble, more flexible and convenient to use, and can improve the fitness effect, and has various functions.

10 Claims, 2 Drawing Sheets

RESISTANCE YOGA POST DEVICE FOR FITNESS

TECHNICAL FIELD

The disclosure relates to the technical field of fitness equipment, and particularly to a resistance yoga post device for fitness.

BACKGROUND

Yoga originated in India and has a history and culture of more than 5000 years. Yoga is called "the treasure of the world". Yoga originated in the foothills of the Himalayas in northern India. When ancient Indian yogis practiced their body and mind in nature, they accidentally found that various animals and plants naturally had methods for treating, relaxing, sleeping, or maintaining alertness. The animals and plants can recover naturally without any treatment when they are ill. Therefore, the ancient Indian yogis observed, imitated and experienced the postures of animals, and created a series of exercise systems beneficial to the body and mind, that is, asana. A yoga post is needed when a yogi practitioner practices yoga.

The existing yoga posts are made of imported PE materials, which are non-toxic, tasteless, odorless and clean, and have pearl luster, light weight, good cushioning elasticity. The yoga posts can help yoga practitioners complete various balance postures. The yoga posts can eliminate muscle tension, strengthen strength and flexibility of muscle strength to achieve the balance of body exercise. The yoga posts have effects of fat reduction and body shaping that can make the body of the yoga practitioner stand out in the crowd, and are necessary equipment in modern yoga practice.

A traditional yoga post has following problems: 1. the traditional yoga post generally only include a cylindrical yoga post which is not stable enough to be used, thereby to affect a fitness effect of the practitioner; 2. the traditional yoga post achieves the fitness effect by rotating a drum and rubbing against a human body; however, the rotation of the drum can only be controlled by the human body pressing on the drum to control a rotating speed, which is very inconvenient to be used; 3. the function of the traditional yoga post is single and the traditional yoga post has low fitness efficiency.

In view of the above, the disclosure provides a resistance yoga post device for fitness to solve the above problems.

SUMMARY

A main purpose of the disclosure is to provide a resistance yoga post device for fitness that is easy to assemble and disassemble, is more flexible and convenient to use, can improve fitness effects, and has various functions.

In order to achieve the above purpose, the disclosure provides the resistance yoga post device for fitness. The resistance yoga post device includes a drum, at least one side of the drum is provided with a first resistance sheet and a first screwing part, and the first screwing part is connected to an end of the roller in the drum through the first resistance sheet.

In an embodiment, a first support is arranged between the first screwing part and the first resistance sheet, the first resistance sheet is disposed in the first support, and the first screwing part is connected to the end of the roller in the drum through the first support.

In an embodiment, a first gasket is arranged between the first screwing part and the first support, and the first screwing part is connected to the first support through the first gasket.

In an embodiment, two sides of the drum are respectively provided with the first resistance sheet and the first screwing part, and a second resistance sheet and a second screwing part; and the second screwing part is connected to another end of the roller in the drum through the second resistance sheet.

In an embodiment, a second support is arranged between the second screwing part and the second resistance sheet, the second resistance sheet is disposed in the second support, and the second screwing part is connected to the another end of the roller in the drum through the second support.

In an embodiment, a second gasket is arranged between the second screwing part and the second support, and the second screwing part is connected to the second support through the second gasket.

In an embodiment, two ends of the roller are provided with a first bearing and a second bearing respectively, the end of the roller is connected to an end of the drum through the first bearing, and the another end of the roller is connected to another end of the drum through the second bearing.

In an embodiment, the first support includes a triangular support base and a circular groove, and the circular groove is disposed on the triangular support base.

In an embodiment, two ends of the drum are provided with a first baffle sheet and a second baffle sheet respectively, the first baffle sheet is disposed at a side of the drum, and the second baffle sheet is disposed at another side of the drum.

In an embodiment, a convex sheet is disposed on the drum.

The disclosure has beneficial technical effects: the two sides of the drum of the yoga post are provided with screwing parts and resistance sheets, the screwing parts are connected to the two sides of the drum through the resistance sheets, so as to control a rotating speed of the drum when a human body is massaged; and the screwing parts provide reaction forces for the human body during massage, achieving sufficient massage and preventing the rotating speed of the drum from getting out of control to hurt the human body.

The two ends of the drum are provided with supports, making the use of the resistance yoga column device more stable, safe, and reliable. The resistance post column device of the disclosure is convenient for disassembly and installation, more flexible in use, diverse in functions, and suitable for being widely popularized and used.

BRIEF DESCRIPTION OF DRAWINGS

In order to provide a clearer explanation of embodiments of the disclosure or the technical solutions in the prior art, a brief description will be given to the attached drawings required in the description of the embodiments or prior art. It is evident that the accompanying drawings in the following description are only some of the embodiments of the disclosure. For those ordinary skilled in the art, other attached drawings can be obtained based on the structures shown in these attached drawings without any creative work.

DESCRIPTION OF REFERENCE NUMERALS

Figure 1:
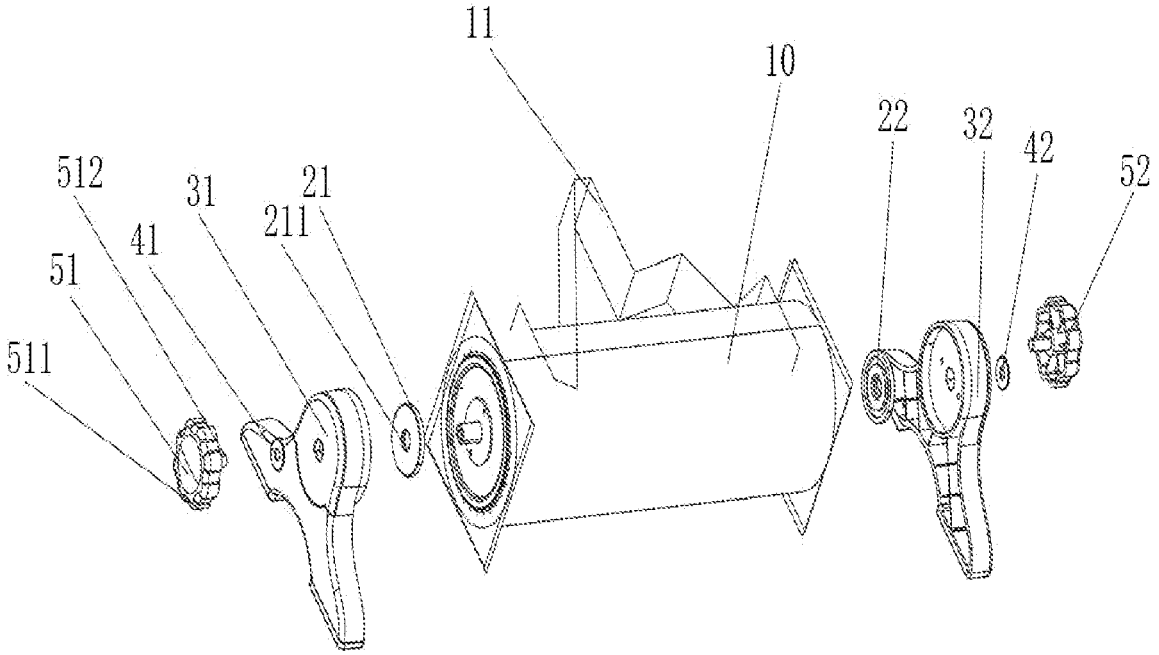
FIG. 1 illustrates a disassembled diagram of a resistance post column device for fitness in an embodiment of the disclosure.

10—drum; 11—convex sheet; 12—roller; 131—first bearing; 132—second bearing; 14—first hole; 151—first baffle sheet; 152—second baffle sheet; 21—first resistance sheet; 211—first through hole; 22—second resistance sheet; 31—first support; 311—triangular support base; 312—circular groove; 313—second through hole; 32—second support; 41—first gasket; 42—second gasket; 51—first screwing part; 511—first screwing cap; 512—first screwing column; 52—second screwing part.

The realization of the purpose, the functional features and the advantages of the disclosure will be further described in combination with the embodiments and the attached drawings.

DETAILED DESCRIPTION OF EMBODIMENTS

The following will provide a clear and complete description of the technical solutions in the embodiments of the disclosure in combination with the attached drawings. Apparently, the described embodiments are only some of the embodiments of the disclosure, not all of them. Based on the embodiments in the disclosure, all other embodiments obtained by those ordinary skilled in the art without creative work should fall within the scope of protection of the disclosure.

It should be noted that all directional indications (such as up, down, left, right, front, rear . . . ) in the embodiments of the disclosure are only used to explain the relative position relationship, motion situation, etc. between components in a specific posture (as shown in the attached drawings). If the specific posture changes, the directional indications also change accordingly.

In the disclosure, unless otherwise clearly defined and limited, terms "connect", "fix", etc. should be understood broadly. For example, "fix" can be a fixed connection, a detachable connection, or a whole; it can be a mechanical connection or an electrical connection; it can be directly connected or indirectly connected through an intermediate medium, or it can be the internal connection between two components or the interaction relationship between two components, unless otherwise specified. For those ordinary skilled in the art, the specific meanings of the above terms in the disclosure can be understood based on specific situations.

In addition, if there are descriptions of "first", "second", etc. in the embodiments of the disclosure, the descriptions of "first", "second", etc. are only used for a purpose of description and cannot be understood as indicating or implying their relative importance or implying the number of indicated technical features. Therefore, features limited to "first" and "second" can explicitly or implicitly include at least one of these features. In addition, the meaning of "and/or" appearing in the disclosure should include three parallel schemes. Taking "A and/or B" as an example, it includes scheme A, or scheme B, or both schemes A and B. In addition, the technical solutions between various embodiments can be combined with each other, but must be based on the ability of those ordinary skilled in the art to achieve. When the combination of technical solutions conflicts or cannot be achieved, it should be considered that the combination of such technical solutions does not exist and is not within the scope of the protection of the disclosure.

The disclosure provides a resistance post column device for fitness.

Embodiment 1

Referring to FIGS. 1, 2, 3, and 4, in an embodiment of the disclosure, the resistance post column device for fitness includes a drum 10, a roller 12 is disposed in the drum 10, at least one side of the drum 10 is provided with a first resistance sheet 21 and a first screwing part 51, and the first screwing part 51 is connected to an end of the roller 12 in the drum 10 through the first resistance sheet 21.

In the embodiment, the first screwing part 51 includes a first screwing cap 511, and a first screwing column 512 is provided on the first screwing cap 511. The first resistance sheet 21 is provided with a first through hole 211. The first screwing cap 511 is connected to the end of the roller 12 through first screwing column 512 passing through the first through hole 211 on the first resistance sheet 21.

In the embodiment, the first screwing part 51 is connected to a side of the drum 10 through the first resistance sheet 21. When the resistance post column device is used, the first screwing part 51 is configured to adjust the tightness of the first resistance sheet 21 to control a rotating speed of the drum 10, so as to control the rotating speed of the drum 10 when a human body is massaged. The first screwing part 51 provides reaction forces for the human body during massage, achieving sufficient massage and preventing the rotating speed of the drum 10 from getting out of control to hurt the human body.

Figure 2:
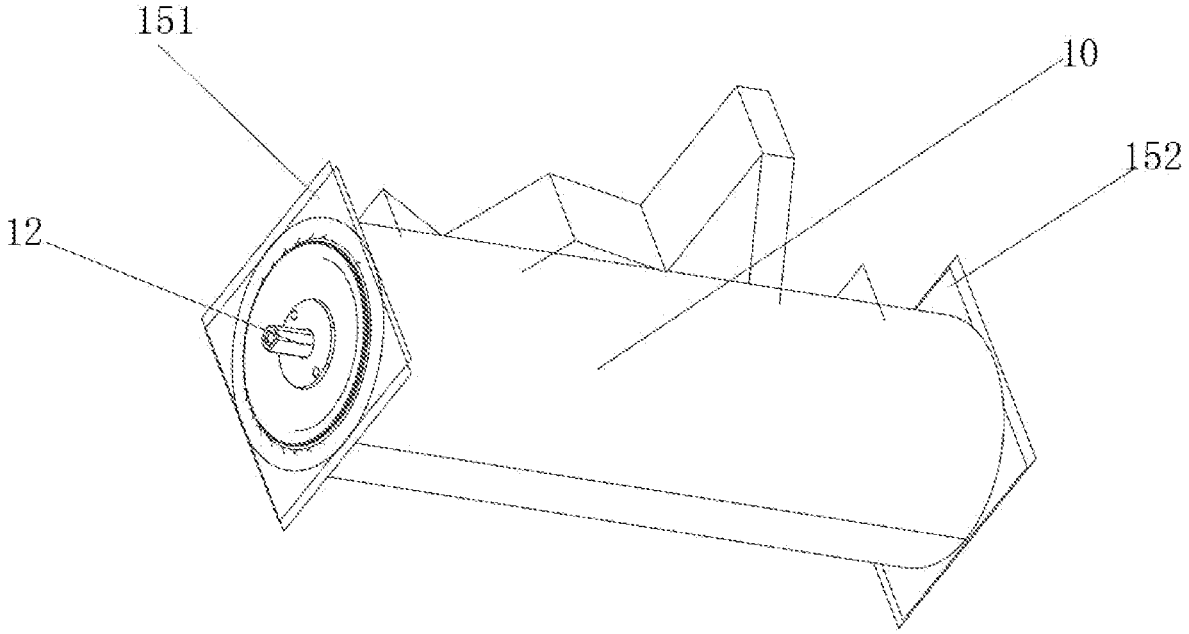
FIG. 2 illustrates a structural diagram of a drum of the resistance post column device for fitness in the embodiment of the disclosure.
Figure 3:
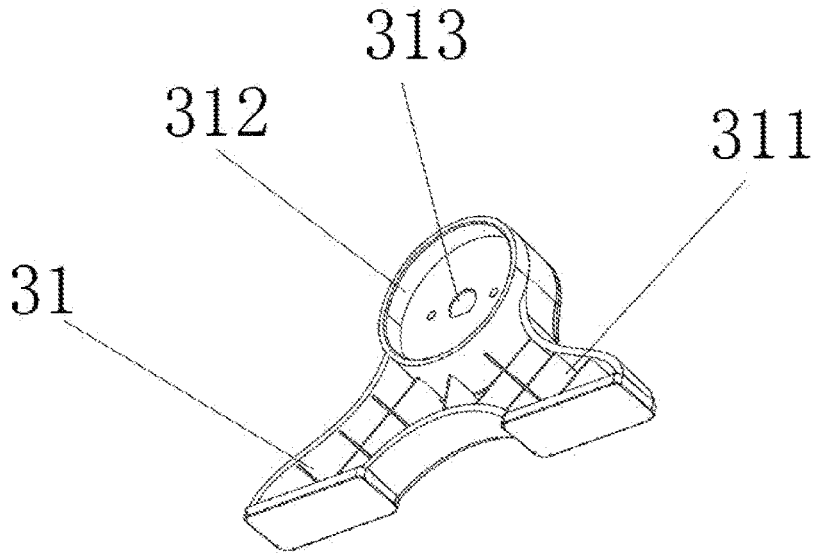
FIG. 3 illustrates a structural diagram of a first support of the resistance post column device for fitness in the embodiment of the disclosure.

Referring to FIGS. 1, 2, and 3, in the embodiment, preferably, a first support 31 is arranged between the first screwing part 51 and the first resistance sheet 21, the first resistance sheet 21 is disposed in the first support 31, and the first screwing part 51 is further connected to the end of the roller 12 in the drum 10 through the first support 31.

In the embodiment, preferably, the first support 31 includes a triangular support base 311 and a circular groove 312, and the circular groove 312 is disposed on the triangular support base 311.

The circular groove 312 is provided with a second through hole 313, the circular groove 312 is slightly larger than the first resistance sheet 21, and the first resistance sheet 21 is arranged in the circular groove 312.

The first screwing part 51 is connected to the end of the roller 12 through the second through hole 313 of the first support 31 and the first through hole 211 of the first resistance sheet 21.

In the embodiment, the first support 31 is provided to make the use of the resistance post column device of the disclosure more stable, safe, and reliable, and to improve the fitness effect of the exerciser.

In the embodiment, preferably, a first gasket 41 is arranged between the first screwing part 51 and the first support 31, and the first screwing part 51 is connected to the first support 31 through the first gasket 41.

In the embodiment, the first gasket 41 is arranged between the first screwing part 51 and the first support 31, and the first screwing part 51 is connected to the first support 31 through the first gasket 41 at the end of roller 12. The first gasket 41 plays a protective and anti-slip role at the end of the roller 12, and prevents friction between the first screwing part 51 and the first support 31, thereby improving the service life of the resistance post column device of the disclosure.

Referring to FIGS. 1, 2, 3, and 4, in the embodiment, in order to make the use of the disclosure more balanced and better improve the fitness effect of the exerciser. Preferably, two sides of the drum 10 are respectively provided with the first resistance sheet 21 and the first screwing part 51, and a second resistance sheet 22 and a second screwing part 52. The second screwing part 52 is connected to another end of the roller 12 in the drum 10 through the second resistance sheet 22.

In the embodiment, the first resistance sheet 21 and the second resistance sheet 22 have the same shape and size. The first screwing part 51 and the second screwing part 52 have the same structure, shape, and size.

In the embodiment, the two sides of the drum 10 are respectively provided with the first resistance sheet 21 and the first screwing part 51, and the second resistance sheet 22 and the second screwing part 52. The first screwing part 51 is configured to control the tightness of the first resistance sheet 21, and the second screwing part 52 is configured to control the tightness of the second resistance sheet 22, thereby to make the rotating speed of the roller 10 of the disclosure more balanced and achieve a better fitness effect.

In the embodiment, preferably, a second support 32 is arranged between the second screwing part 52 and the second resistance sheet 22, the second resistance sheet 22 is disposed in the second support 32, and the second screwing part 52 is further connected to the another end of the roller 12 in the drum 10 through the second support 32.

In the embodiment, preferably, the first support 31 and the second support 32 have the same structure, size, and shape. The first support 31 and the second support 32 are arranged at the two sides of the drum 10 respectively, thereby to make the use of the disclosure more stable and make the fitness safer and more reliable.

In the embodiment, preferably, a second gasket 42 is arranged between the second screwing part 52 and the second support 32, and the second screwing part 52 is connected to the second support 32 through the second gasket 42.

In the embodiment, preferably, the first gasket 41 and the second gasket 42 have the same shape, size, and function. The second gasket 42 has a protective effect on the friction between the second screwing part 52 and the second support 32, thereby improving the service life of the resistance post column device of the disclosure.

Referring to FIG. 5, in the embodiment, preferably, two ends of the drum 10 are provided with a first baffle sheet 151 and a second baffle sheet 152 respectively, the first baffle sheet 151 is disposed at the side of the drum 10, and the second baffle sheet 152 is disposed at another side of the drum 10.

In the embodiment, the first baffle sheet 151 and the second baffle sheet 152 are configured to make the sealing of the drum 10 tighter, and the rotation of the drum 10 is safer and more reliable.

In the embodiment, preferably, two ends of the roller 12 are provided with a first bearing 131 and a second bearing 132 respectively, the end of the roller 12 is connected to an end of the drum 10 through the first bearing 131, and the another end of the roller 12 is connected to another end of the drum 10 through the second bearing 132.

In the embodiment, preferably, the end of the drum 10 is provided with a first hole 14, and the another end of the drum 10 is provided with a second hole (not shown in FIGS.) correspondingly. The first bearing 131 is connected to the end of the drum 10 through the first hole 14, and the end of the roller 12 is exposed on the side of the drum 10 by passing through the first hole 14. The second bearing 132 is connected to the another end of the drum 10 through the second hole, and the another end of the roller 12 is exposed on the another side of the drum 10 by passing through the second hole.

Since the first bearing 131 and the second bearing 132 are arranged in the drum 10, the control of the rotation of the drum 10 is more convenient and flexible. Therefore, the resistance post column device is more convenient to be used.

Figure 4:
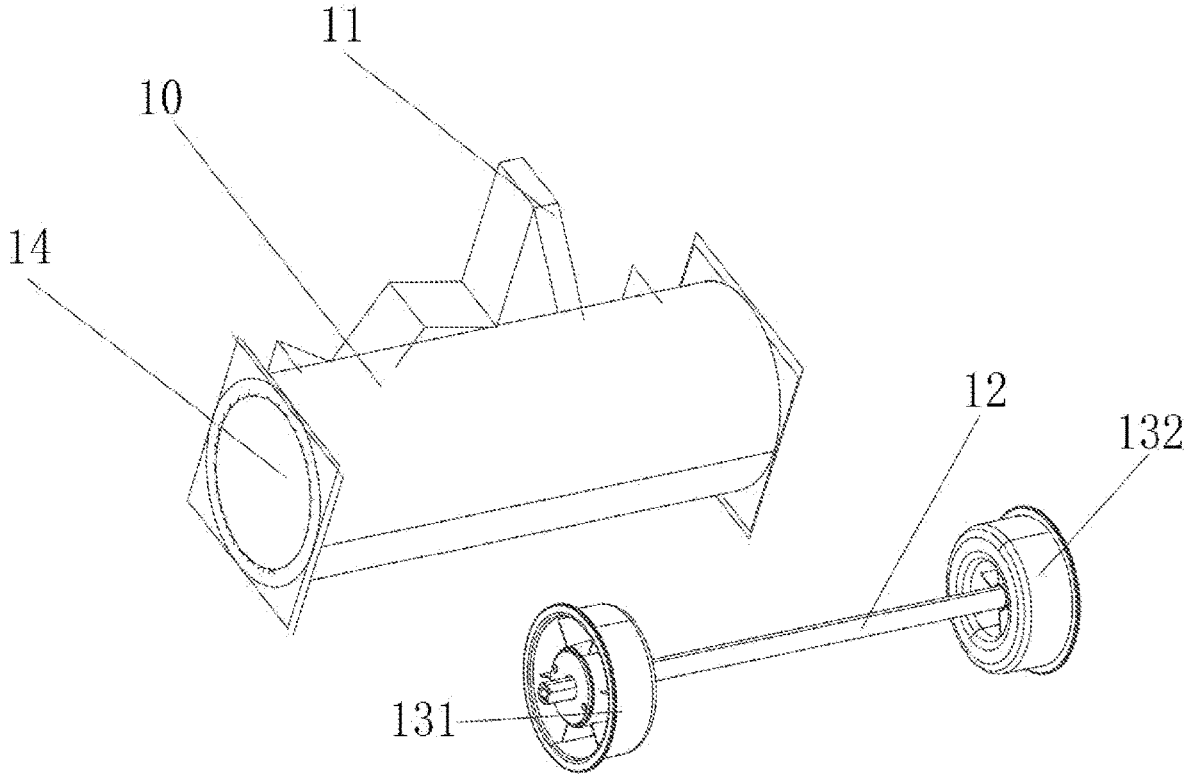
FIG. 4 illustrates a disassembled diagram of the drum of the resistance post column device for fitness in the embodiment of the disclosure.

Referring to FIGS. 1, 2, and 4, in the embodiment, preferably, a convex sheet 11 is disposed on the drum 10. When the body of the exerciser presses the drum 10 and rubs on the drum 10, the convex sheet 11 is configured for deeper and finer friction between the body of the exerciser and a contact area of the convex sheet 11. The convex sheet 11 enhances the fitness effect and increases the function of the resistance post column device of the disclosure, which is popular among the exercisers.

The above are only some embodiments of the disclosure and do not limit the scope of the protection of the disclosure. Any equivalent structural changes made by using the description and attached drawings of the disclosure, or direct/indirect applications in other related technical fields should be included in the scope of protection of the disclosure.

What is claimed is:

1. A resistance yoga post device for fitness, comprising a drum; wherein a roller is disposed in the drum, at least one side of the drum is provided with a first resistance sheet and a first screwing part, and the first screwing part is connected to an end of the roller in the drum through the first resistance sheet;

wherein a first support is arranged between the first screwing part and the first resistance sheet, the first resistance sheet is disposed in the first support, and the first screwing part is connected to the end of the roller in the drum through the first support;

wherein a first gasket is arranged between the first screwing part and the first support, and the first screwing part is connected to the first support through the first gasket.

2. The resistance yoga post device for fitness according to claim 1, wherein two sides of the at least one side of the drum are respectively provided with the first resistance sheet and the first screwing part; and a second resistance sheet and a second screwing part, and the second screwing part is connected to another end of the roller in the drum through the second resistance sheet.

3. The resistance yoga post device for fitness according to claim 2, wherein a second support is arranged between the second screwing part and the second resistance sheet, the second resistance sheet is disposed in the second support, and the second screwing part is connected to the another end of the roller in the drum through the second support.

4. The resistance yoga post device for fitness according to claim 3, wherein a second gasket is arranged between the second screwing part and the second support, and the second screwing part is connected to the second support through the second gasket.

5. The resistance yoga post device for fitness according to claim 4, wherein two ends of the roller are provided with a first bearing and a second bearing respectively, the end of the roller is connected to an end of the drum through the first bearing, and the another end of the roller is connected to another end of the drum through the second bearing.

6. The resistance yoga post device for fitness according to claim 5, wherein the first support comprises a triangular support base and a circular groove, and the circular groove is disposed on the triangular support base.

7. The resistance yoga post device for fitness according to claim 6, wherein two ends of the drum are provided with a first baffle sheet and a second baffle sheet respectively, the first baffle sheet is disposed at one of the two sides of the at least one side of the drum, and the second baffle sheet is disposed at another one of the two sides of the at least one side of the drum.

8. The resistance yoga post device for fitness according to claim 7, wherein a convex sheet is disposed on the drum.

9. A resistance yoga post device for fitness, comprising: a drum, a convex sheet, a roller, bearings, resistance sheets, supports, screwing parts, gaskets, and baffle sheets;

wherein the roller is disposed in the drum, and two ends of the roller are connected to two ends of the drum through the bearings respectively, and the bearings are disposed in the drum; the convex sheet is disposed on an outside of the drum; and wherein the screwing parts are disposed at two sides of the drum respectively, and each of the screwing parts is connected to the roller through a corresponding one of the gaskets, a corresponding one of the supports, and a corresponding one of the resistance sheets sequentially in that order; and the baffle sheets are disposed at the two sides of the drum respectively, and each of the baffle sheets is disposed between a corresponding one of the resistance sheets and the drum.

10. The resistance yoga post device for fitness according to claim 9, wherein each of the supports comprises: a support base and a groove disposed on the support base, the support base is provided with a through hole located in the groove; each of the screwing parts comprises a screwing cap and a screwing column fixedly connected to the screwing cap; and wherein the screwing column passes through the through hole of the corresponding support, and the corresponding resistance sheet is disposed in the groove of the corresponding support.

* * * * *